US005095509A

United States Patent [19]

Volk

[11] Patent Number: 5,095,509

[45] Date of Patent: Mar. 10, 1992

[54] AUDIO REPRODUCTION UTILIZING A BILEVEL SWITCHING SPEAKER DRIVE SIGNAL

[76] Inventor: William D. Volk, 527 Channing, Palo Alto, Calif. 94301

[21] Appl. No.: 576,590

[22] Filed: Aug. 31, 1990

[51] Int. Cl.[5] ..... G10L 5/02

[52] U.S. Cl. ..... 381/51; 395/2

[58] Field of Search ..... 381/51-53; 364/513.5, 710.12

[56] References Cited

U.S. PATENT DOCUMENTS

| | | | |
|---|---|---|---|
| 4,392,018 | 7/1983 | Fette | 381/51 |
| 4,437,087 | 3/1984 | Petr | 340/347 |
| 4,592,070 | 5/1986 | Chow et al. | 381/31 |
| 4,617,645 | 10/1986 | Sprague | 307/490 |
| 4,692,941 | 9/1987 | Jacks et al. | 381/52 |
| 4,805,220 | 2/1989 | Sprague et al. | 381/51 |

*Primary Examiner*—Dale M. Shaw
*Assistant Examiner*—Michelle Doerrler
*Attorney, Agent, or Firm*—Schroeder, Davis & Orliss Inc.

[57] ABSTRACT

Speech and other audio output is produced from a digitally driven speaker which is turned on and off by a digital control signal derived from a digitally sampled audio input. Digitally encoded samples of an audio signal are converted to a sequence of bits, 1's and 0's, to control the application of a fixed frequency ultrasonic drive signal to a personal computer speaker. Prior to the signal conversion, the digital samples are compensated utilizing error propagation techniques for audio errors introduced by the conversion from audio levels to full on or full off speaker control bits.

15 Claims, 4 Drawing Sheets

AUDIO REPRODUCTION UTILIZING A BILEVEL SWITCHING SPEAKER DRIVE SIGNAL

BACKGROUND OF THE INVENTION

The present invention relates generally to digital audio systems and, more particularly, to a system for driving a conventional speaker with a digital signal for the production of speech.

It is known in the prior art to convert audio signals, such as voice or musical signals, to digital signals, such as a pulse coded modulation (PCM) signal, which may then be recorded or transmitted to a distant point for reproduction. Specifically, an analog audio signal is digitally sampled at a constant rate, commonly 11 KHz or some integer multiple, and a digital word is generated and stored or transmitted at each sampling, the digital word representing the polarity and magnitude of the analog audio signal at the time of sampling. The digital word is then converted back to analog and applied to a conventional speaker.

Conventional vibrating cone or diaphragm-type speakers or audio transducers are analog devices. Additionally, the speakers provided in commercially available, consumer oriented personal computer (PC) products typically are inexpensive, relatively low quality components to maintain the cost of the PC at a competitive level. Such low-cost speakers are well-suited for typical personal computer PC applications in which only single-frequency tones or game noises are produced. For tones such as the "bell" tone commonly utilized in personal computer PC applications, a pulse train is generated which turns the speaker on and off at the desired tone frequency. For game sounds, such as "crashes" and "gunshots", a random waveform centered about zero is digitally generated and infinitely clipped and applied to the speaker.

Typically, again as a cost-saving measure, personal computers do not include a digital-to-analog converter (DAC) and its associated circuitry. While the production of relatively simple sounds may be satisfactorily accomplished by applying a digital or clipped signal directly to a speaker, high quality, recognizable speech and other complex audio utilized by today's sophisticated computer games and other audio systems require the use of a DAC to produce acceptable audio.

U.S. Pat. No. 4,805,220 issued on Feb. 14, 1989 to Richard P. Sprague and Kevin R. Kachikian discloses an all-software speech generating system which applies a digital signal to a computer speaker to switch the speaker on and off at an ultrasonic carrier rate and which varies the speaker on/off duty cycle at audio frequencies according to the speech or sound to be produced. Speech is produced by modulating the duty cycle of a square-wave carrier signal in such a manner as to continuously vary the pulse length in accordance with the audio signal representing the desired speech to be produced. While the speech generating system of U.S. Pat. No. 4,805,220 produces acceptable speech without the use of a DAC, errors arising from the difference in speaker diaphragm position at various audio levels and in the full on or off positions are not compensated for. The speech quality and overall fidelity of the sound produced may be improved utilizing error compensation techniques.

SUMMARY OF THE INVENTION

A digital audio system in accordance with the principles of the present invention produces high quality speech and audio from digitally sampled audio in an apparatus such as a personal computer which provides two levels of output voltage to a speaker or other audio output device. The system converts a sequence of digitally encoded samples of audio input to a sequence of bits, 1's and 0's, to turn a speaker on or off according to the audio signal to be produced. When the speaker is turned on, it is driven by fixed frequency digital signal at an ultrasonic rate.

In accordance with the invention, data expansion and error compensation techniques are utilized to improve the audio output quality. Errors generated by the digitally encoded sample level corresponding to the amplitude and polarity of the audio signal at the time of sampling and the audio level represented by the speaker at full on or full off are compensated for by propagation of errors to adjacent succeeding digital samples prior to conversion of each sample to a corresponding bit. Use of an ultrasonic frequency drive signal for the speaker minimizes speaker ring during periods of silence when the speaker is on.

The digital audio system of the present invention may be implemented entirely in software which utilizes the CPU and other components in commercially available PCs to perform the error compensation and data conversion. Alternatively, the system could be implemented entirely in hardware on a plug-in card for use in a PC under control of the CPU or as a stand-alone unit requiring only an audio input and power provided that a speaker is included. Desired audio samples, including complete audio scripts, may be converted to a sequence of bits stored in memory, as in a ROM or CD, for playback at a later time in various PC applications, such as computer games.

BRIEF DESCRIPTION OF THE DRAWING

A fuller understanding of the present invention will become more apparent from the following detailed description taken in conjunction with the accompanying drawing which forms a part of the specification and in which.

DETAILED DESCRIPTION OF THE PREFERRED EMBODIMENT

Figure 1:
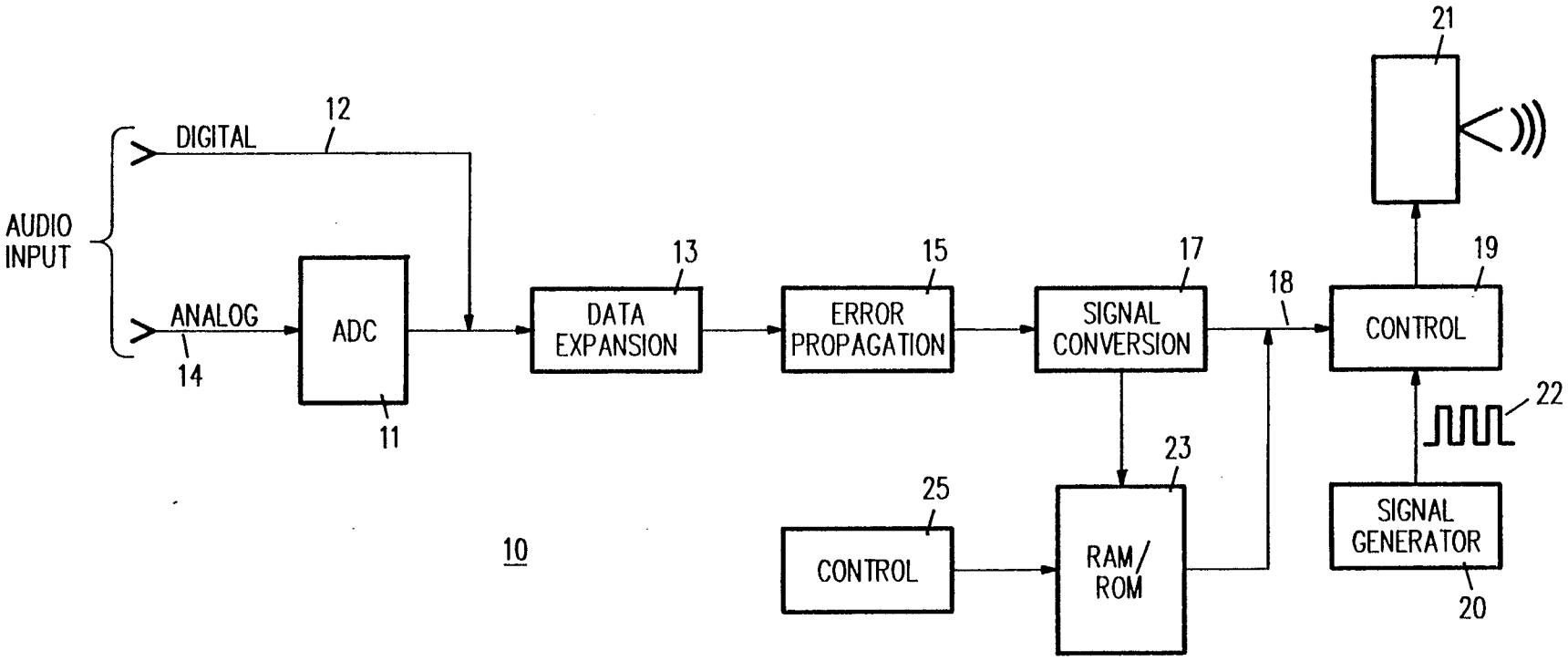
FIG. 1 is a conceptual block diagram of a digital speech system according to the principles of the present invention.

Referring to FIG. 1, a conceptual block diagram of a digital audio system 10 according to the present invention for producing high quality audio output from a digitally driven speaker is illustrated. The system illustrated may be implemented entirely in software which utilizes the central processing unit (CPU) and other components in commercially available personal computers (PC). Such a software program utilizes a PC CPU to generate a digital signal on line 18 calculated from an audio input on lines 12 or 14 to control the application of an ultrasonic digital signal 22 to a speaker 21. Alternatively, the system 10 may be implemented entirely in hardware for use in a PC under control of the CPU or as a stand-alone unit requiring only an audio input and power provided that the speaker 21 is included.

The digital audio system 10 of the present invention converts a digital audio sample comprising an array of numbers, i.e., digital words, corresponding to the audio levels of a sound sample to a sequence of bits which are utilized to turn a speaker 21 on and off in accordance with original sound input. When turned on, speaker 21 is driven at a fixed ultrasonic rate by a digital signal 22 generated by signal generator 20. Each sample of the audio signal is a digital word representing the polarity and magnitude of the analog voice signal at the time of sampling. The audio input may be a digital signal on line 12 provided by a speech synthesizer or other source such as a compact disk storage media or an analog voice signal on line 14 input to analog to digital converter (ADC) 11. The digital speech samples are encoded levels representing the polarity and magnitude of the audio input signal. The number of levels, or resolution of the digital samples is, determined by the resolution of ADC 11. For example, an 8 bit ADC provides digital samples encoded in 256 levels, the most negative audio signal corresponding to a level 0 and the most positive audio signal level corresponding to level 255. In one embodiment of the present invention, the audio digital samples are encoded in 256 levels at a sample rate of 22 KHz.

The digital audio sample data is then expanded by a predetermined factor, m, to provide additional data points for error compensation. While the data expansion factor is arbitrary, an expansion factor of at least 8 is recommended for best results. The data expansion process 13 may be accomplished by mere repetition of each sample or by a linear or nonlinear interpolation function between each sample and the next succeeding sample. In the preferred embodiment, a data expansion factor of 8 is utilized to provide 8 times the audio sample rate data points each second.

Figure 2:
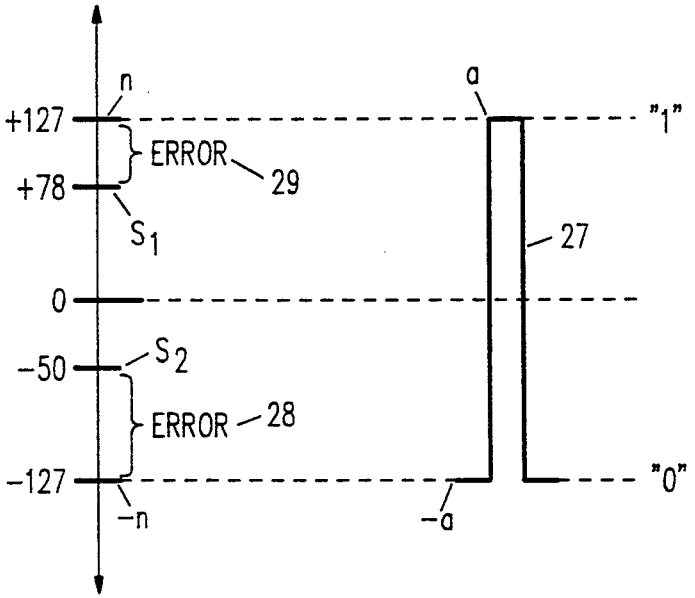
FIG. 2 is a diagram illustrating the conversion of the audio signal level to the digital speaker control signal and the associated digital error.
Figure 4:
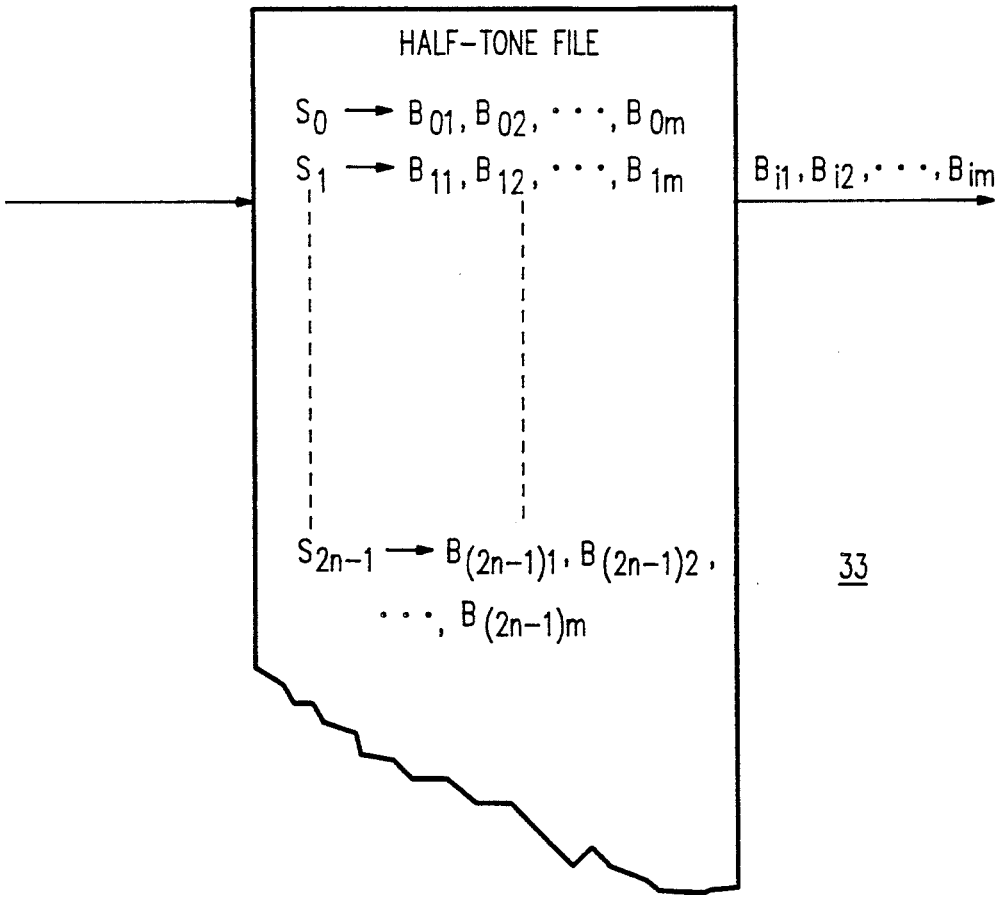
FIG. 4 is a diagram illustrating the format of the half-tone file shown in FIG. 3.

Referring now also to FIG. 2, a digital sample can be represented by a range of levels from n to −n in value. For example, sample $S_1$ has a value of +78. Additionally, two values, a and −a, are set to represent the two states, i.e., on and off, of the audio output device or speaker 21. As shown in FIG. 2, the values a, −a correspond to the 1 and 0 values, respectively, of pulse or bit 27, corresponding to on and off, respectively, of speaker 21. If a sample value, $S_i$, is closer to the value a than the value −a, then a corresponding bit value equal to 1 is assigned to bit 27. Similarly, if the sample value is closer to −a than to the value of a, $S_2$ as shown in FIG. 2, then a bit value of 0 is assigned to bit 27. Since the value of a sample represents the actual physical position of a speaker diaphragm which will be different, in most cases, than the speaker diaphragm position when the speaker is full on (bit value assigned=1) or when the speaker is full off (bit value assigned=0), an error will exist for each sample $S_i$. The position error 29 may be represented by $e_i=S_i-a$, if the corresponding bit value is 1. The position error 28 may be represented by $e_i=-S_i+a$, if the bit value assigned=0. A portion of the error $e_i$ corresponding to each sample $S_i$ is propagated to subsequent adjacent samples. The next succeeding samples each receive predetermined portions of the error $e_i$ added to their value to generate corrected samples $S_{ic}$. Corrected samples, $S_{ic}$, are value-limited in a range from n to −n to prevent over compensation in error propagation. A corrected sample then is given by:

$$S_{ic} = S_i + \sum_{j=1}^{p} A_j e_{i-j}$$

where $A_j$ is a selectable proportionality constant, p is the degree of error propagation and $$e_{i-j}=S_{(i-j)c}+a \text{ if } S_{i-j}>0$$

$$e_{i-j}=S_{(i-j)c}-a \text{ if } S_{i-j}<0$$

Each of the corrected samples, $S_{ic}$, is converted to a corresponding bit 27 having a value of either 1 or 0 as a function of the value of the sample, $S_{ic}$, as described hereinabove. Signal conversion process 17 thus provides a digital control signal on line 18 representative of the original audio input which turns speaker 21 on or off via control circuit 19 at a rate corresponding to the original sample rate multiplied by a data expansion factor. When the speaker 21 is turned on by the control signal, the speaker 21 is driven at a constant ultrasonic rate 22 by digital signal 22 generated by signal generator 20. Silence, i.e., zero audio signal, is produced by tuning the speaker on and driving the speaker at the ultrasonic rate 22 during the period of silence.

Alternatively, the control signal generated by the signal conversion process 17 may be stored in memory such as a RAM or ROM 23 for later playback under control of a host PC, CPU 25 or other user to control input 25.

Figure 3:
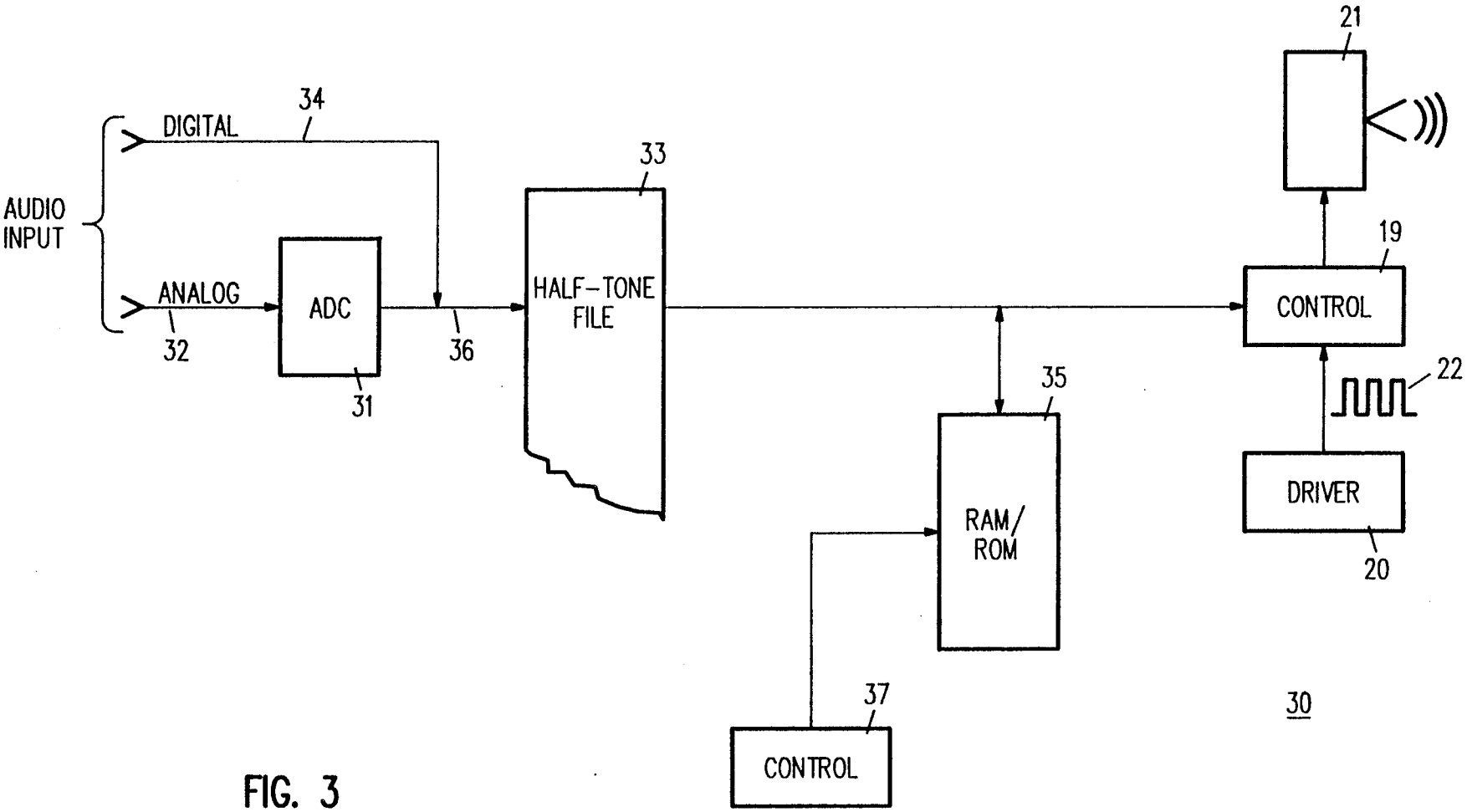
FIG. 3 is a conceptual block diagram of another preferred embodiment of the digital speech system according to the principles of the present invention.

Referring now to FIG. 3, a block diagram illustrating another preferred embodiment of the digital audio system of the present invention is shown. As described with reference to FIGS. 1 and 2, an audio signal is input either in digital format on line 34 or in analog format on line 32 to ADC 31 to provide digital words corresponding to the digital samples, $S_i$, representing the audio input to half tone file 33 on line 36. Half tone file 33 comprises a look up table of all possible sample values from −n to n individually converted to a sequence of bits utilizing the data expansion 13, error propagation and signal conversion processes, 15 and 17, respectively, as described above with reference to FIG. 1. Each input sample is mapped to a corresponding set of bits $B_{i1}, B_{i2}, \ldots, B_{im}$, where m is the data expansion factor. At the time the values for the half tone file 33 are calculated, the actual sample values are not known. Therefore, the error for a given sample $S_i$ is propagated only to the samples $S_{ij}$ resulting from the expansion of the sample $S_i$. Therefore, the corrected sample value for the sequence of samples $S_{ij}$ resulting from the expansion of a sample $S_i$ on line 36 is given by $$S_{ij} = E(S_i)_j + \sum_{k=1}^{j-1} (A_{j-k})(e_{j-k})$$

Where j ranges over the expansion factor m and $E(S_i)_j$ represents the data expansion function.

The output of half tone file 33 on line 38 then is a digital control signal comprising groups of bits, each group of bits corresponding to an input sample $S_i$ on line 36. The digital control signal is applied to control circuitry 19 to toggle the speaker 21 on and off at a rate equal to the data sample rate times the expansion factor. As described above with reference to FIG. 1, the speaker 21 is driven by a digital signal 22 from driver 20 wherever the speaker is turned on. Similarly, the control signal may be stored in a file in memory 35 for playback at a later time under control of the host PC, CPU or other control input 37.

While use of the half-tone table 33 in the system of FIG. 3 is faster, the quality of the speech output may not match that of the real time process described with reference to FIG. 1 because the sample conversion errors are propagated only over the "m" expansion for each digital sample $S_i$. Further, for digital resolution greater than 8 bits (256 levels), memory requirements become significant.

Figure 5:
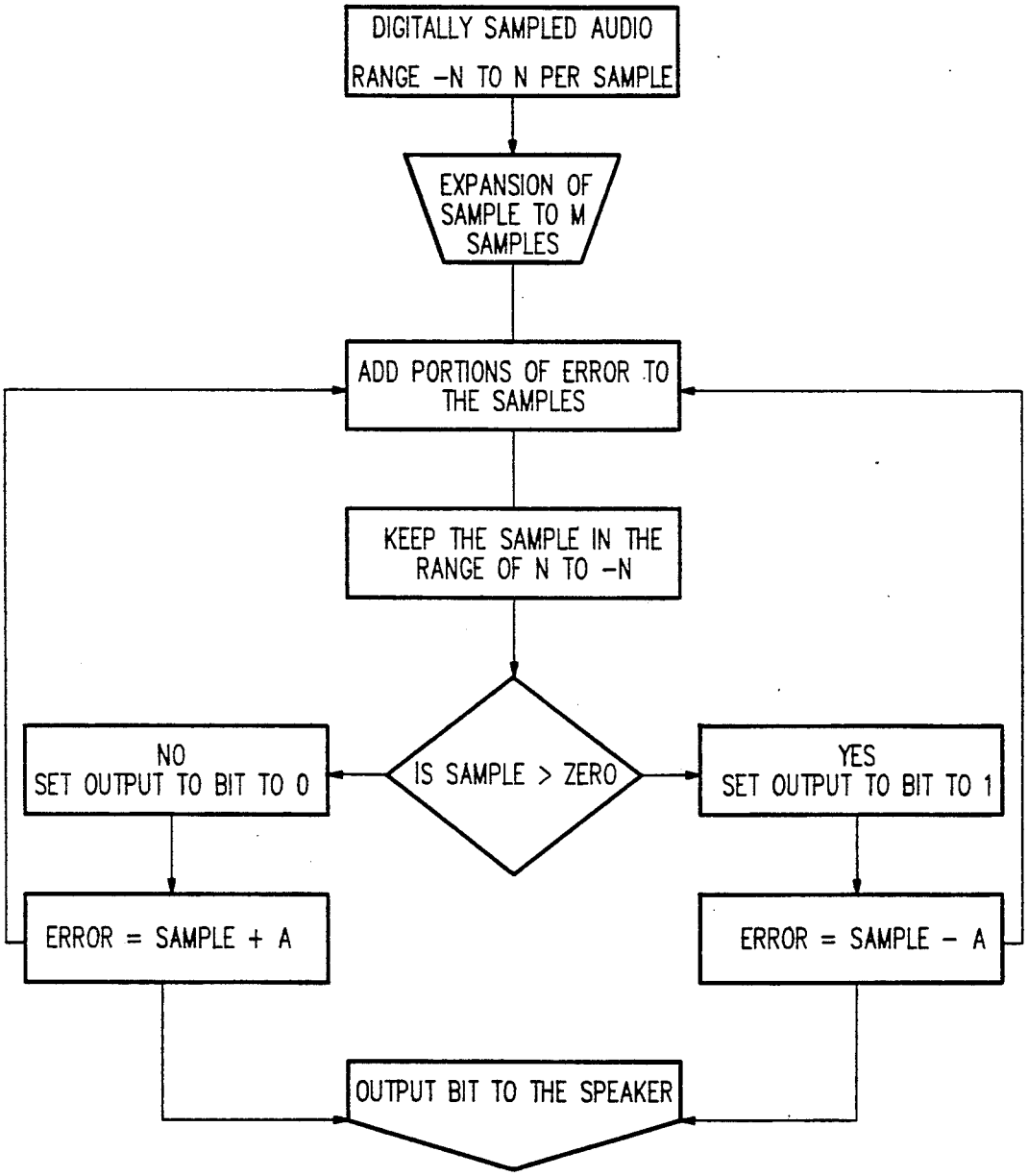
FIG. 5 is a flow diagram illustrating the method for digital speech production as implemented in the system shown in FIG. 1.

Referring now to FIG. 5, a flow chart illustrating the data processes in a computer program implementing the digital audio system of FIG. 1 is shown. As discussed above with reference to FIG. 1, the expansion factor m, a digital sample level range n and the value a, corresponding to full on or full off of the speaker 19, are selectable to allow tailoring of the program to the actual output device and host PC utilized. Further, the degree of propagation of error distribution can be adjusted to provide the best results. The audio data sample rate is set by Nyquist's law for digital sampling, which states that the digital sample rate must be twice the audio frequency for faithful reproduction by the speaker 21. In the present invention, a sample rate of 22 KHz is preferred, since it is more than sufficient for natural sounding speech and typically exceeds the response capability for the typical PC speaker.

The present invention has been particularly described with reference to a preferred embodiment thereof. However, it should be understood that the foregoing detailed description is only illustrative of the invention and those skilled in the art will recognize the changes in form and detail may be made without departing from the spirit of the invention or exceeding the scope of the appended claims.

I claim:

1. Apparatus for generating a digital speaker drive signal from digitally encoded audio samples, comprising:

error propagation means for determining an error between an audio level represented by a digitally encoded sample of a sequence of digitally encoded samples and an audio level represented by a speaker control signal corresponding to said digitally encoded sample, each of said digitally encoded samples having a value corresponding to successive audio levels in an audio signal, respectively, and for altering the values of adjacent succeeding digitally encoded samples by combining predetermined portions of said error with a predetermined number of said adjacent succeeding digitally encoded samples for generating a sequence of error compensated digital samples representative of said audio signal;

conversion means coupled to said error propagation means for converting said sequence of error compensated digital samples to a sequence of bits corresponding on a one-to-one basis to said sequence of error compensated digital samples; and control means coupled to said conversion means and responsive to said sequence of bits for producing a fixed frequency digital speaker drive signal.

2. Apparatus as in claim 1 further comprising data expansion means coupled to an input of said error propagation means for expanding said sequence of digitally encoded samples by a predetermined expansion factor in accordance with a specified data expansion function for providing an expanded audio data signal for error compensation.

3. Apparatus as in claim 2 further comprising analog to digital conversion means coupled to said data expansion means for receiving an analog audio signal and converting said analog audio signal to said sequence of digitally encoded samples.

4. Apparatus as in claim 1 further comprising storage means coupled to said conversion means and said control means for storing said sequence of bits.

5. Apparatus as in claim 1 wherein said fixed frequency is in the ultrasonic range of frequencies.

6. Apparatus as in claim 1 wherein said control means includes signal generator means for generating a fixed frequency speaker drive signal.

7. A method for generating a digital speaker control signal from digitally encoded audio samples, comprising the steps of:

determining an error between an audio level represented by a digitally encoded sample of a sequence of digitally encoded samples and an audio level represented by a speaker control signal corresponding to said digitally encoded sample;

combining predetermined portions of said error with adjacent succeeding digitally encoded samples of said sequence of digitally encoded samples for generating a corresponding sequence of error compensated digital samples;

converting said sequence of error compensated digital samples to a sequence of bits corresponding on a one-to-one basis to said sequence of error compensated digital samples; and producing a fixed frequency digital speaker drive signal in accordance with said sequence of bits.

8. The method of claim 7 including the step of expanding said sequence of digitally encoded samples for providing an expanded audio data signal for error compensation.

9. The method as in claim 8 wherein said step of expanding includes the step of expanding in accordance with a specified data expansion factor.

10. The method as in claim 7 further including the step of storing said sequence of bits.

11. Apparatus for generating a digital speaker drive signal from a sequence of digitally encoded audio samples, comprising:

first memory means for storing a set of groups of bits, each of said groups of bits associated with a predefined audio level, each said group of bits corrected for the error between said associated predefined audio level and the audio level of a speaker control signal corresponding to said associated predefined audio level, said first memory means responsive to an input sequence of digitally encoded audio samples, each of said digitally encoded audio samples corresponding to the audio level of successive samples in an audio signal, for outputting a sequence of said groups of bits, each of said groups of bits in said sequence of groups of bits corresponding on a one-to-one basis, respectively, with each of said digitally encoded audio samples; and control means coupled to said first memory means and responsive to said sequence of groups of bits for producing a fixed frequency digital speaker drive signal.

12. Apparatus as in claim 11 wherein said set of groups of bits comprise a look-up table, said look-up table including a file of groups of bits associated with all defined audio levels for an audio signal.

13. Apparatus as in claim 12 wherein each said group of bits comprises a predetermined number of bits in accordance with a predetermined data expansion factor.

14. Apparatus as in claim 13 wherein each bit in each of said groups of bits is assigned a value in accordance with a predetermined error compensation function.

15. Apparatus as in claim 11 further comprising second memory means coupled to said first memory means and to said control means for storing said sequence of groups of bits.

* * * * *